US009087503B2

(12) United States Patent
Setoguchi

(10) Patent No.: US 9,087,503 B2
(45) Date of Patent: Jul. 21, 2015

(54) SAMPLING DEVICE AND SAMPLING METHOD

(71) Applicant: CASIO COMPUTER CO., LTD., Tokyo (JP)

(72) Inventor: Masaru Setoguchi, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/450,121

(22) Filed: Aug. 1, 2014

(65) Prior Publication Data

US 2015/0040740 A1 Feb. 12, 2015

(30) Foreign Application Priority Data

Aug. 12, 2013 (JP) ..... 2013-167456

(51) Int. Cl.
*G10H 7/02* (2006.01)
*G10H 1/18* (2006.01)
*G10H 1/00* (2006.01)

(52) U.S. Cl.
CPC ..... *G10H 7/02* (2013.01); *G10H 1/0083* (2013.01); *G10H 1/18* (2013.01); *G10H 2210/076* (2013.01); *G10H 2210/381* (2013.01); *G10H 2250/641* (2013.01)

(58) Field of Classification Search
IPC ..... G10H 7/02,2250/641
See application file for complete search history.

(56) References Cited

U.S. PATENT DOCUMENTS 4,206,676 A * 6/1980 Adachi et al. ..... 84/672
4,987,600 A * 1/1991 Rossum ..... 381/118
4,991,218 A * 2/1991 Kramer ..... 381/61
5,085,119 A * 2/1992 Cole ..... 84/724
5,086,475 A * 2/1992 Kutaragi et al. ..... 704/265
5,111,727 A * 5/1992 Rossum ..... 84/603
5,248,845 A * 9/1993 Massie et al. ..... 84/622
5,298,671 A * 3/1994 Bliss ..... 84/603
5,300,724 A * 4/1994 Medovich ..... 84/604
5,303,309 A * 4/1994 Rossum ..... 381/118
5,342,990 A * 8/1994 Rossum ..... 84/603
5,506,371 A * 4/1996 Gillaspy ..... 84/699
6,124,542 A * 9/2000 Wang ..... 84/603
6,138,207 A * 10/2000 Rossum ..... 711/118
6,630,621 B1 * 10/2003 Yamada et al. ..... 84/603

(Continued)

FOREIGN PATENT DOCUMENTS

JP H06-175663 A 6/1994
JP H09-325776 A 12/1997

(Continued)

*Primary Examiner* — David Warren
(74) *Attorney, Agent, or Firm* — CHEN YOSHIMURA LLP

(57) ABSTRACT

A sampling device includes: an obtainer that obtains a streaming audio waveform; a detector that detects a tap by a user; a designator that designates a sampling start point on the obtained audio waveform when at least a single tap has been detected by the detector, the designating being performed on the basis of one tap among a plurality of the taps when the plurality of taps are detected; a calculator that calculates a sampling duration on the basis of time intervals between the respective taps when the plurality of taps are detected, the calculating being performed from the sampling start point to a subsequent tap that is performed after the one tap; and a waveform sampler that samples the obtained audio waveform, the sampling starting from the designated sampling start point and ending in accordance with the calculated sampling duration.

10 Claims, 4 Drawing Sheets

(56) References Cited

U.S. PATENT DOCUMENTS

| | | | | |
|---|---|---|---|---|
| 7,107,401 | B1 * | 9/2006 | Savell et al. | 711/118 |
| 2001/0017821 | A1 * | 8/2001 | Inoue et al. | 369/32 |
| 2001/0017829 | A1 * | 8/2001 | Inoue et al. | 369/47.23 |
| 2002/0198690 | A1 * | 12/2002 | Holzrichter et al. | 702/195 |
| 2003/0171933 | A1 * | 9/2003 | Perille | 704/500 |
| 2004/0069118 | A1 * | 4/2004 | Okazaki et al. | 84/603 |
| 2004/0200336 | A1 * | 10/2004 | Senoo et al. | 84/612 |
| 2008/0013757 | A1 * | 1/2008 | Carrier | 381/119 |
| 2014/0225845 | A1 * | 8/2014 | Muzar et al. | 345/173 |
| 2014/0229829 | A1 * | 8/2014 | Mazur et al. | 715/716 |
| 2014/0366710 | A1 * | 12/2014 | Eronen et al. | 84/609 |
| 2015/0040740 | A1 * | 2/2015 | Setoguchi | 84/603 |
| 2015/0081064 | A1 * | 3/2015 | Ball et al. | 700/94 |
| 2015/0081065 | A1 * | 3/2015 | Ball et al. | 700/94 |
| 2015/0081613 | A1 * | 3/2015 | Ball et al. | 706/52 |
| 2015/0082973 | A1 * | 3/2015 | Buskies et al. | 84/603 |

FOREIGN PATENT DOCUMENTS

| | | | |
|---|---|---|---|
| JP | 2001-075570 | A | 3/2001 |
| JP | 4656822 | B2 | 3/2011 |

* cited by examiner

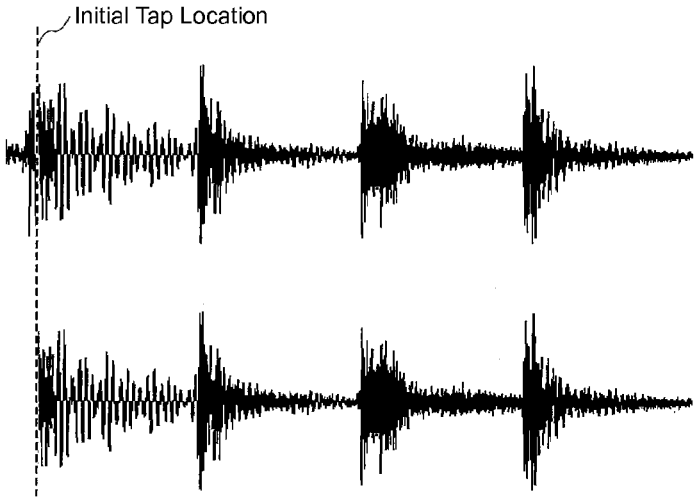
FIG. 3A
FIG. 3B
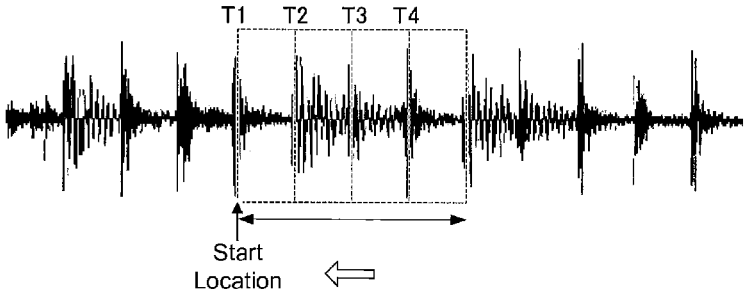
FIG. 4A
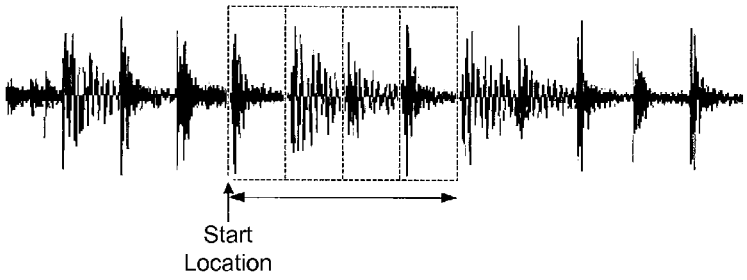
FIG. 4B

SAMPLING DEVICE AND SAMPLING METHOD

BACKGROUND OF THE INVENTION

1. Field of the Invention

The present invention relates to a sampling device and a sampling method.

2. Description of Related Art

Conventionally, an electronic musical instrument called a "sampler" can store external sound or music as digital data (hereinafter, "sampling") and replay these stored data (hereinafter, "sampling data") through operation of a keyboard or the like.

There are typically several methods in samplers to signal the start and end of sampling. One method of starting and ending sampling is providing an operating element such as a switch for signaling the start and end of sampling, and then starting and ending sampling through user operation of this operating element, for example. There is also a method in which a function called "auto-trigger" is used to automatically start sampling when the level of sound or music inputted through a microphone or the like exceeds a certain threshold. When using this auto-trigger function, sampling is ended through signaling by the operating element, for example.

When obtaining a sound from a percussion instrument such as a drum in order to repeatedly play this obtained sampling data (hereinafter, "looping") for musical accompaniment, there are times when the obtained sampling data does not meet the required length of time of 1 beat×number of beats. As a result, during looping the rhythm may differ from the lead player performing with this accompaniment, and this could ruin the performance.

It is necessary to set the length of time of 1 beat×number of beats as the required length, but as a countermeasure to the above problem, there is a method in which sampling data of the required length is obtained by ending sampling in accordance with a single beat calculated from pre-configured tempo information (Patent Document 1 2001-075570). There is another possible method to solve the above problem by using an editing function to adjust the length of the sampling data to meet the required length after the sampling data has been obtained.

In Patent Document 1 described above, however, the user must pre-configure the tempo information. It is also possible that the configured tempo does not match the piece being played.

In contrast, in the method in which an editing function is used to adjust the sampling data after being obtained, the data length can be set to match the tempo of the piece being performed. On the other hand, the editing work in this method requires a certain level of skill at operating the device and the like.

Therefore, in either case it is common for operations beyond mere sampling to be required and for the operation itself to be complicated, require a certain level of skill, and be problematic for a beginner.

SUMMARY OF THE INVENTION

The present invention was made in view of such conditions and aims at providing a sampling device and a sampling method in which it is possible to perform sampling through intuitive and simple operation.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present invention is a sampling device of the present invention includes: an obtainer that obtains a streaming audio waveform; a detector that detects a tap by a user; a designator that designates a sampling start point on the obtained audio waveform when at least a single tap has been detected by the detector, the designating being performed on the basis of one tap among a plurality of the taps when the plurality of taps are detected; a calculator that calculates a sampling duration on the basis of time intervals between the respective taps when the plurality of taps are detected, the calculating being performed from the sampling start point to a subsequent tap that is performed after the one tap; and a waveform sampler that samples the obtained audio waveform, the sampling starting from the designated sampling start point and ending in accordance with the calculated sampling duration.

A sampling method according to one aspect of the present invention executed by a sampling device includes: obtaining a streaming audio waveform; detecting a tap by a user; designating a sampling start point on the obtained audio waveform when at least a single tap has been detected by a detector, the designating being performed on the basis of one tap among a plurality of the taps when the plurality of taps are detected; calculating a sampling duration on the basis of time intervals between the respective taps when the plurality of taps are detected, the calculating being performed from the sampling start point to a subsequent tap that is performed after the one tap; and sampling the obtained audio waveform, the sampling being performed from the designated sampling start point and ending in accordance with the calculated sampling duration.

A storage medium according to one aspect of the present invention includes: programs stored on a computer that controls a sampling device, the programs respectively executing: obtaining of a streaming audio waveform; detecting of a tap by a user; designating of a sampling start point on the obtained audio waveform when at least a single tap has been detected by the detecting, the designating being performed on the basis of one tap among a plurality of the taps when the plurality of taps are detected; calculating of a sampling duration on the basis of time intervals between the respective taps when the plurality of taps are detected, the calculating being performed from the sampling start point to a subsequent tap that is performed after the one tap; and sampling of the obtained audio waveform, the sampling being performed from the designated sampling start point and ending in accordance with the calculated sampling duration.

It is to be understood that both the foregoing general description and the following detailed description are exemplary and explanatory, and are intended to provide further explanation of the invention as claimed.

BRIEF DESCRIPTION OF THE DRAWINGS

FIGS. 3A and 3B are schematic views showing differences between tap location and waveform start location of an inputted sound.

FIGS. 4A and 4B are schematic views for explaining modifications of the sampling starting point.

DETAILED DESCRIPTION OF THE PREFERRED EMBODIMENTS

<Configuration of Electronic Instrument>

Figure 1:
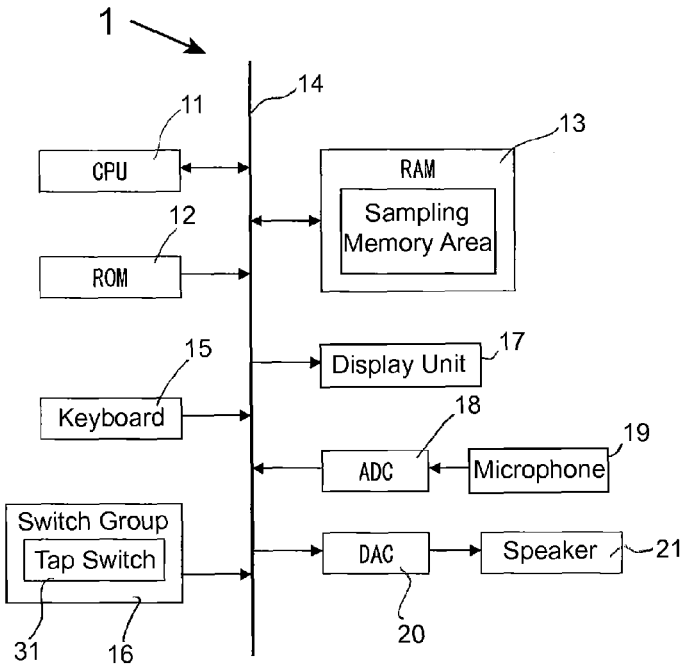
FIG. 1 is a block diagram showing hardware of an electronic instrument according to Embodiment 1 of the present invention.

FIG. 1 is a block diagram showing hardware of an electronic instrument 1 according to Embodiment 1 of the present invention.

The electronic instrument 1 is an electric piano, for example. The electronic instrument 1 of the present embodiment includes a function in which sounds from a CD, a live performance, or the like are sampled and then generated as sampling data, and a function in which this sound source is played for accompaniment during keyboard performances.

As shown in FIG. 1, this type of electronic instrument 1 includes a CPU (central processing unit) 11, a ROM (read only memory) 12, a RAM (random access memory) 13, a bus 14, a keyboard 15 (an operating element that designates pitch), a switch group 16, a display unit 17, an ADC (analog-digital converter circuit) 18, a microphone 19, a DAC (digital-analog converter circuit) 20, and a speaker 21.

The CPU 11 executes various types of processes, such as controlling the entire electronic instrument 1, detecting pressing of the keys on the keyboard 15 and operating of the switches (a tap switch and the like as described later, for example) in the switch group 16, controlling the display unit 17 and the like in accordance with the operations of the keys and the switches, and controlling timing of the sound in accordance with the type of tone quality that has been selected.

The CPU 11 executes a sampling data generation process. The sampling data generation process is the series of processes in which the sound desired for sampling is inputted from a microphone 19 or the like, input operation is performed at a desired timing, and sampling data of a desired tempo is attained. The process flow in the sampling data generation process is described later.

The ROM 12 stores various types of programs for execution by the CPU 11, such as various types of processes corresponding to operation of the switches and pressing of the respective keys on the keyboard, sound command for music corresponding to the respective pressed keys, and controlling of the sound timing in accordance with the type of tone quality selected, for example.

The RAM 13 stores waveform data for generating the music of an acoustic piano, electric piano, electric organ, harpsichord, and the like, and also stores musical pieces for accompaniment. The RAM 13 also stores the sound or music inputted via the microphone 19 in a sampling memory area as sampling data. The sampling memory area of the RAM 13 functions as a ring buffer.

The RAM 13 also stores programs read from the ROM 12 and temporary data during processing.

The CPU 11, the ROM 12, and the RAM 13 are connected to each other through the bus 14. The keyboard 15, the switch group 16, the display unit 17, the ADC 18, and the DAC 20 are also connected to this bus 14.

The keyboard 15 has a plurality of keys. There are keys corresponding to the white notes of a piano, and keys corresponding to the black notes of a piano. In the present embodiment, the keyboard 15 functions as an operating element that outputs the piano sound corresponding to the respective keys, and also functions as an operating element that outputs sampling data corresponding to the pitch of the respective keys.

The switch group 16 includes various types of switches, such as a tap switch 31.

The tap switch 31 is a switch that is an operating element serving as an input structure and that can signal the start and end of sampling.

The display unit 17 displays various types of information related to the piece being played, such as the type of tone quality, rhythm pattern, and code name, for example. The inputted waveform can also be displayed on the display unit 17.

The ADC 18 is an analog-digital converter circuit that converts analog signals to digital signals. The microphone 19 is connected to the ADC 18.

The ADC 18 is an input structure that converts the analog signal sound inputted through the microphone 19 to a digital signal and then inputs this to the CPU 11. The CPU 11 stores the inputted digital signal in the RAM 13 as sound data, such as sampling data.

The DAC 20 is a digital-analog converter circuit that converts digital signals to analog signals, and is connected to the speaker 21. The speaker 21 outputs the sampling data that has been converted into an analog signal by the DAC 20 as sound.

The electronic instrument 1 as configured above has functions allowing for the sampling data that will serve as a prescribed tempo to be intuitively obtained.

In the electronic instrument 1 with such functions, sound is obtained from external music data, a CD (compact disc), or a live performance in real-time to generate sampling data that includes tempo information.

<Operating Principle>

The operating principle of the electronic instrument 1 of the present embodiment will be explained below.

Figure 2:
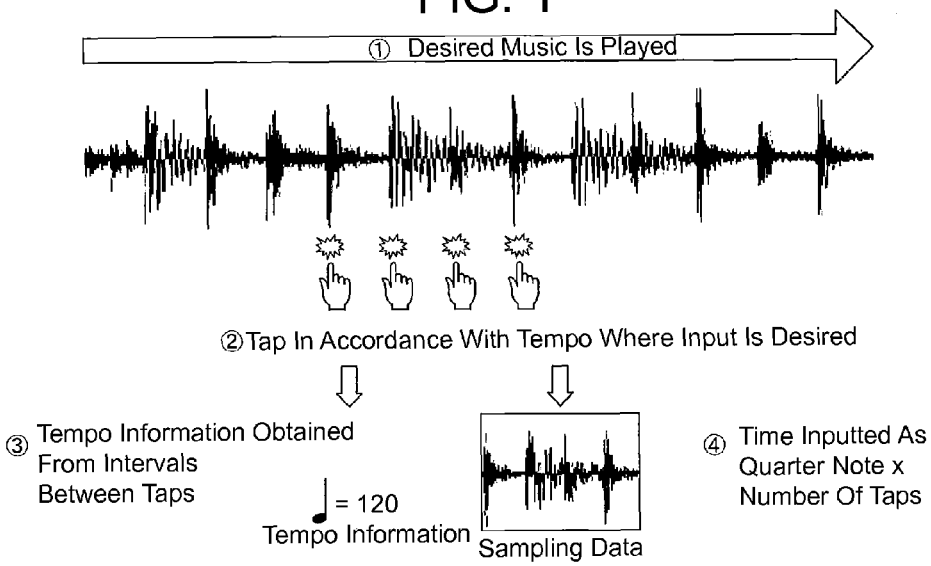
FIG. 2 is a conceptual view of a sampling method of the present embodiment.

FIG. 2 is a conceptual view of a sampling method of the present embodiment.

The electronic instrument 1 of the present embodiment generates sampling data by sampling part of a music source in which reproduced sound from a CD has been inputted or in which a live performance has been obtained in real-time through the microphone 19, for example. Tempo information, which is a tempo value, is also added to the sampling data that will be generated by an operation performed at the time of sampling.

Specifically, as shown in FIG. 2, the target sound is inputted in real-time in the electronic instrument 1 (1). Then, with the electronic instrument 1, at the location where input is desired the user taps in accordance with the desired tempo on the tap switch 31 (2). Thereafter, with the electronic instrument 1, the tempo information is obtained from the delay between the taps (3). Finally, the sampling data with the tempo information and the timing of the tap frequency is stored in the RAM 13 in the electronic instrument 1 (4).

In the example in FIG. 2, a CD is played and tapping is done four times at a prescribed timing, for example. In the electronic instrument 1, the tempo information is obtained from the delay between the taps (in the present example, M.M.=120). Thereafter, the sampling data is inputted at a length of quarter note×number of taps (four times).

When the sampling data is stored in the RAM 13 in the electronic instrument 1 (4), in the present embodiment the user indicates that the first tapping of the tap switch 31 is the start of sampling. In this case, if the point at which the user taps the tap switch 31 is the start of sampling, then sampling is performed from the middle of the sound that the user wishes to sample. In other words, there is a time-lag from when a person recognizes the sound until indicating the start of sampling by tapping the tap switch 31, and thus, if the point at which the user taps the tap switch 31 is the start of sampling, then sampling will be performed from the middle of the sound that the user wishes to sample.

FIGS. 3A and 3B are schematic views showing differences between tap location and waveform start location of an inputted sound.

Specifically, if the user recognizes the sound and taps the tap switch 31 to sample this sound, then as shown in FIG. 3A, the tapping of the tap switch 31 will be performed in the middle of the waveform, or namely, in the middle of the sound.

As shown in FIG. 3B, assuming that this waveform is sampled and played, the sound would start abruptly at the starting point. If looped, the performance would also be awkward due to this fragment of sound at the joints of the loop.

Therefore, in the electronic instrument 1 of the present embodiment, the acquired location in the sampling data is shifted from the location where tapping occurred to the starting location of the sound meant for sampling.

FIGS. 4A and 4B are schematic views for explaining modifications of the sampling starting point.

Specifically, as shown in FIG. 4A, when the location of a first tap T1 is in the middle of a sound, then as shown in FIG. 4B, the sampling starting location is shifted backwards to before the entire time obtained during sampling to a starting location of the sound where the waveform begins. By shifting the entire time of the sample in this manner, the target sound can be sampled without modifying the length of the sampling data.

In the electronic instrument 1, sampling is performed with the starting point as the location that has been shifted to the start of the sound. In the electronic instrument 1, in order to make it possible to modify the starting location of sampling, a temporary recording is preemptively initialized, without storing the sound at the start of sampling, so as to determine the start address of the sampling data when sampling length (sampling time) is defined.

In the present embodiment, in order for the sampling memory area of the RAM 13 to function as a ring buffer, the recording will return to the head of the buffer when the end is reached, and recording will continue.

If the starting location of sampling is modified in this manner in consideration of the above-mentioned human characteristics, then it is possible to obtain a sampling sound that matches what is desired by the user, or namely, a sampling sound from the beginning of the sound itself.

The tempo information is obtained on the basis of the tapping of the tap switch 31. In the electronic instrument 1, starting from the tapping of the tap switch 31 that indicates the start of sampling, tempo information is generated by the delay between taps when tapping the tap switch 31 at the desired tempo.

Specifically, in the present embodiment, the tempo information is generated as a tempo value that is the frequency of time units (1 minute) during the average delay of a plurality of taps.

With this type of method, the user can generate tempo information through intuitive operation. Furthermore, the tempo information can be obtained at the same time as the sampling; therefore, it is not necessary for the user to separately enter the tempo information before or after the sampling. Input related to the generation of tempo information is performed while the user listens to the sound they wish to sample, thereby allowing the tempo information to be obtained in accordance with the intention of the user.

<Entire Process>

Figure 5:
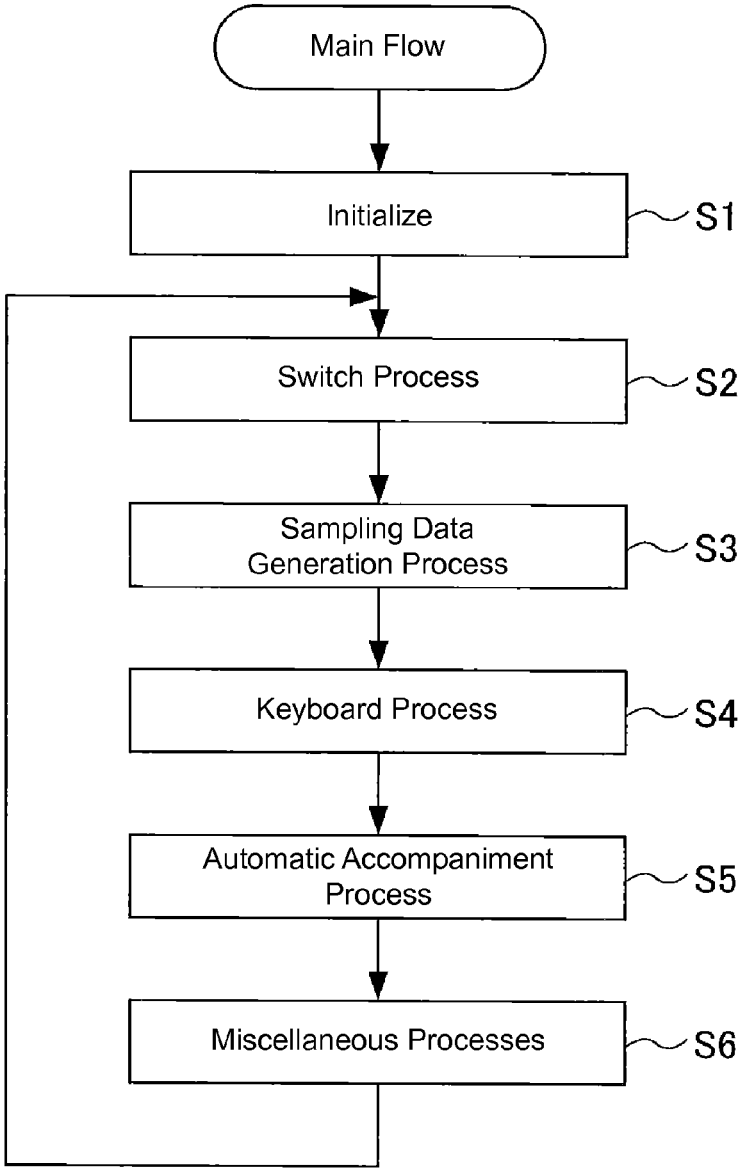
FIG. 5 is a flow chart showing all processes executed in the electronic instrument of the present embodiment.

FIG. 5 is a flow chart showing all processes executed in the electronic instrument 1 of the present embodiment.

In step S1, the CPU 11 performs initialization when powered on.

In step S2, the CPU 11 performs a switch process. In the switch process, the CPU 11 detects operation signals of various types of switches, such as the switch that designates the tone quality of a sound.

In step S3, the CPU 11 performs a sampling data generation process (described later in FIG. 6).

In step S4, a keyboard process is performed. In the keyboard process, it is detected which type of key has been pressed. This results in Note On or Note Off being determined, and the corresponding sound is outputted.

In step S5, the CPU 11 performs an automatic accompaniment process. In the automatic accompaniment process, accompaniment data is played. In the present embodiment, the accompaniment data includes sampling data, and the accompaniment data is played by looping the sampling data.

This enables the performer to perform with the sampling sound source, which is looped at a desired tempo, as the accompaniment.

In step S6, the CPU 41 performs other processes. Various other types of processes are performed in these processes, such as the CPU 11 displaying music sheet data on the display unit 17, for example.

<Sampling Data Generation Process>

Figure 6:
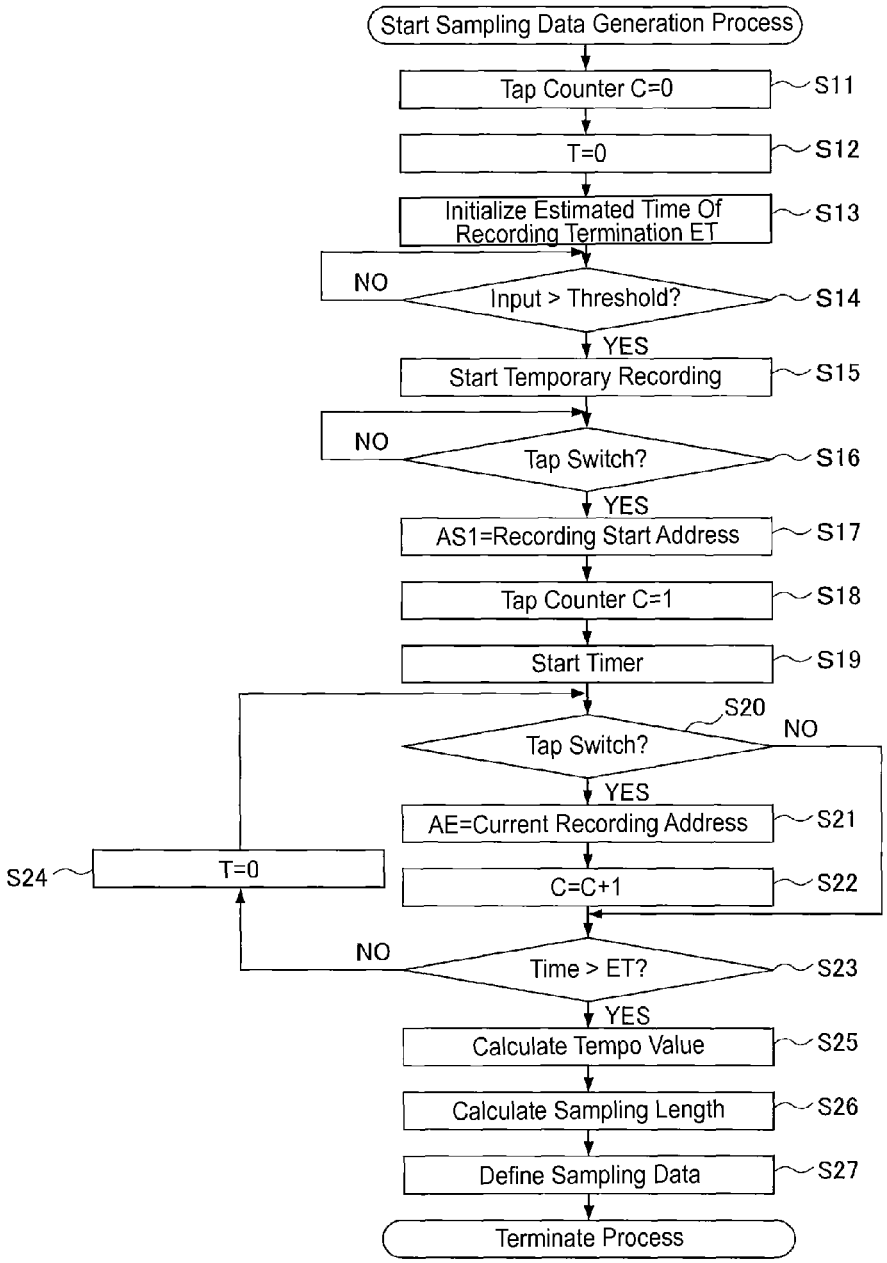
FIG. 6 is a flowchart of a detailed flow of the sampling data generation process out of all the processes.

FIG. 6 is a flowchart of a detailed flow of the sampling data generation process out of all the processes.

In step S11, the CPU 11 resets a tap counter C ("Tap Counter C=0").

In step S12, the CPU 11 resets a timer T ("T=0").

In step S13, the CPU 11 sets the starting value of an estimated time of recording termination ET. In other words, the CPU 11 initializes the estimated time of recording termination ET. The "Estimated Time of Recording Termination ET" is a necessary variable for ending the recording when no input operation on the tap switch has occurred for at least a prescribed amount of time.

In the present embodiment, the minimum tempo value is 30. Therefore, the initial value for the estimated time of recording termination ET would be 60 seconds/30=2 seconds. This is because if the estimated time of recording termination ET is above this value, then the tempo will fall below 30, thus becoming lower than the minimum tempo value and being unable to be used.

In step S14, the CPU 11 determines whether the input amplitude from the microphone input is at or above a certain threshold.

When there is no input amplitude from the microphone input or if the input is at or below a certain threshold, then step S14 is NO, and the CPU 11 waits until there is input at or above a certain threshold.

Conversely, if the input amplitude from the microphone input is at or above a certain threshold, then step S14 is YES, and the process proceeds to step S15.

In step S15, the CPU 11 starts the temporary recording. In other words, the CPU 11 starts the temporary recording because some type of sound has been inputted in step S14.

In the present embodiment, the temporary recording is performed before the input operation (recording starting operation) on the tap switch. The user will hear a sound, decide to tap, and then perform the input operation on the tap switch; thus, the tap will happen later than the starting location of the waveform, and the user will not be able to perform the input operation on the tap switch at the start of the sound to be obtained. Therefore, in the present embodiment, it is necessary to make the start of sampling data be a time before the input operation on the tap switch.

In step S16, the CPU 11 determines whether there has been an input operation on the tap switch.

When there is no touch operation on the tap switch, then step S16 is NO, and the CPU 11 waits until there is an input operation on the tap switch.

Conversely, when there is an input operation on the tap switch, then step S16 is YES, and the process proceeds to step S17.

In step S17, the CPU 11 stores the address of the recording memory as a variable AS that indicates the recording start address ("AS=Recording Start Address").

In step S18, the CPU 11 sets the tap counter C to 1 ("Tap Counter C=1").

In step S19, the CPU 11 starts the timer for measuring time. In other words, the CPU 11 incrementally increases a time variable T as a time process.

In step S20, the CPU 11 determines whether there has been an input operation on the tap switch.

When there is no input operation on the time switch, then step S20 is NO, and the process proceeds to step S24. The processes after step S24 will be described later.

Conversely, when there is an input operation on the tap switch, then step S20 is YES, and the process proceeds to step S21.

In step S21, when there is an input operation on the tap switch S20, the CPU 11 stores the recording address at the time of input as a variable AE that indicates the current recording address ("AE=Current Recording Address"). The contents of AE are renewed every time there is tap switch input.

In step S22, the CPU 11 incrementally increases a tap countdown C ("C=C+1").

In step S23, the CPU 11 determines whether the timer value has exceeded the estimated time of recording termination ET that was initialized in step S13.

When the timer value has not exceeded the estimated time of recording termination ET, then step S23 is NO, and the process proceeds to step S24 in order to wait for input operation on the tap switch.

In step S24, the CPU 11 resets the timer value T ("T=0").

Conversely, when the timer value exceeds the estimated time of recording termination ET, then step S24 is YES, and the process proceeds to step S25.

In step S25, when the non-input time has exceeded the estimated time of recording termination ET and the recording is considered to have ended, the CPU 11 defines the tempo value. The tempo value is defined by calculating a time t from the first tap switch input to the last tap switch input and then calculating an average time mt between the tap switch inputs from the time t. In the electronic instrument 1, the tempo information is generated by defining the tempo value.

Specifically, the calculating of the time t from the first tap switch input to the last tap switch input is performed as in formula (1) below.

$$t=(AE-AS)/FS \qquad \text{Formula (1):}$$

Here, "t" represents the time from the first tap switch input to the last tap switch input, "AE" represents the current recording address, "AS" represents the recording starting address, and "FS" represents the sampling frequency "Hz" at the time of recording.

Next, the average time mt between the tap switch inputs is performed as in formula (2) below.

$$mt=t/(C-1) \qquad \text{Formula (2):}$$

Here, "mt" represents the average time between the tap switch inputs, "t" represents the time from the first tap switch input to the last tap switch input, and "C" represents the tap countdown value.

Next, the tempo value is defined with the calculated average time mt between the tap switch inputs as a single beat. In other words, the tempo value is defined as in formula (3) below.

$$\text{tempo value}=60/mt \qquad \text{Formula (3):}$$

Here, "mt" represents the average time between tap switch inputs.

In step S26, the CPU 11 calculates the sampling length.

Specifically, the sampling length is calculated as in formula (4) below.

$$SC=mt\times C\times FS \qquad \text{Formula (4):}$$

Here, "SC" represents the sampling length, "mt" represents the average time between tap switch inputs, "C" represents the tap counter value, and "FS" represents the sampling frequency (Hz) at the time of recording.

In step S27, the CPU 11 determines the cut-off locations of the samples from the length of the samples found in step S26 in order to define the sampling data.

When defining sampling data, there is a possibility that the head of the waveform may be cut out if the timing when the user first presses the tap switch is set as the starting location of sampling, as described above. Therefore, as shown in FIGS. 4A and 4B, the starting location of sampling is shifted to be earlier than this. The amount of shift is set at an appropriate amount at an approximate percentage (approximately 5%, for example) of the mt, due to the samples mt of a single beat being calculated from the tempo value. This makes it possible to reliably obtain the sound the user desires from the start point of the sound.

Then, the process ends.

By going through the above-mentioned processes, with the electronic instrument 1 of the present embodiment, the user can obtain a suitable length of sampling data corresponding to the tempo that has been tapped and the number of taps.

Furthermore, the tempo information can be obtained at the same time as the sampling; therefore, it is not necessary for the user to separately enter the tempo information before or after the sampling. Input related to the generation of tempo information is performed while the user listens to the sound they wish to sample, thereby allowing the tempo information to be obtained in accordance with the intention of the user.

The configuration and processes of the electronic instrument 1 of the present embodiment was described above.

In the present embodiment, the CPU 11 detects input operations and generates tempo information on the basis of the input delays of the plurality of input operations that are detected.

Accordingly, in the electronic instrument 1, tempo information can be generated by the user listening to a sound and merely performing the input operation at the desired timing. Therefore, with the electronic instrument 1, sampling can be performed through intuitive and simple operation.

In the present embodiment, the CPU 11 generates tempo information on the basis of the average delays of the input delays of the plurality of input operations.

Accordingly, with the electronic instrument 1, tempo information can be generated through intuitive operation.

In the present embodiment, the CPU 11 calculates the number of beats per unit of time of the average delay of the input delays between the plurality of input operations.

The CPU 11 generates the calculated number of beats as the tempo information.

Accordingly, in the electronic instrument 1, tempo information can be generated through intuitive operation.

In the present embodiment, the CPU 11 obtains inputted waveforms. The CPU 11 determines the starting location of the sampling on the basis of the first input operation.

The CPU 11 performs sampling from the determined starting location and generates sampling data corresponding to this tempo information.

Thus, in the electronic instrument 1, sampling can be performed through intuitive and simple operation.

In the present embodiment, the CPU 11 modifies the determined starting location to the time of output of the sound that is meant to be sampled, which is a time before the first input operation.

Thus, with the electronic instrument 1, the desired sound can be reliably sampled from the start of the sound.

The present invention is not limited to the embodiment above, and includes changes, modifications, or the like made within a scope by which it is possible to attain the object of the present invention.

In the embodiment described above, the length of the sampling data was determined on the basis of the calculated tempo information, but without being limited thereto, the length may be determined by the length of a pre-configured number of beats.

In the embodiment described above, the starting point of sampling was determined on the basis of the sampling length calculated from the tempo information, but the present invention is not limited thereto. The starting point of sampling may be the starting point of a waveform, where the waveform is determined and there are instructions for sampling of the waveform, for example.

In the embodiment described above, the electronic instrument 1 (recording and replaying device) has a configuration in which the sound is sampled, sampled data with tempo information is generated, and the generated sampling data can be looped, but the present invention is not limited thereto. It is also possible to have a device in which sampling data with tempo information is generated from a sound played or the like externally, or a device in which tempo information is generated, for example.

In the embodiment described above, the electronic instrument 1 using the sampling device of one aspect of the present invention was described in an example as being an electric piano, but the present invention is not limited thereto.

The present invention can also be generally applied to electronic devices having a sampling data generation function, for example. Specifically, one aspect of the present invention can be applied to notebook personal computers, printers, television receivers, video cameras, portable navigation devices, mobile phones, smartphones, portable game systems, and the like.

The series of processes described above can be accomplished by hardware or software.

In other words, the functional configuration in FIG. 1 is merely an example, and the present invention is not limited thereto. Namely, the type of functional blocks used to achieve these functions are not limited to the example in FIG. 1 as long as a function in which the series of processes described above can be fully executed is included in the electronic instrument 1.

One functional block may be a single hardware unit or a single software unit, or these may be combined.

If the series of processes are accomplished by software, the programs constituting the software are installed on a computer or the like through a network or a storage medium.

The computer may be installed in specialized hardware. The computer may be a computer that can execute various functions by installing various programs, or it may be a general personal computer, for example.

The storage medium including such a program is not only distributed separately from a main device body in order to provide the user with programs; it is also provided to the user pre-installed in the main device body. The storage medium is removable media, a magnetic disk (including a floppy disk), an optical disc, a magneto-optical disk, or the like, for example. The optical disc is a CD-ROM (compact disc-read only memory), a DVD (digital versatile disc), a Blu-ray Disc, or the like, for example. The magneto-optical disk is an MD (MiniDisc) or the like. The storage medium provided to the user pre-installed in the main storage body is a hard disk or the like included in the ROM 12 or RAM 13 of FIG. 1 in which a program is stored, for example.

In the present specification, the step of storing the programs in the storage medium includes not only time-oriented processes that take place in that order but also parallelly or individually executed processes.

One embodiment of the present invention was described above, but this is merely an example and does not limit the technological scope of the present invention. Various other embodiments can be made of the present invention, and it is possible to make various modifications such as omissions or replacements of elements within a scope that does not depart from the gist of the present invention. Embodiments and modifications thereof are included in the scope and gist of the invention disclosed in the present specification and the like, and are included in the invention disclosed in the claims and an equivalent thereof.

It will be apparent to those skilled in the art that various modification and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A sampling device, comprising:

an obtainer that obtains a streaming audio waveform;

a detector that detects a tap by a user;

a designator that designates a sampling start point on the obtained audio waveform when at least a single tap has been detected by the detector, said designating being performed on the basis of one tap among a plurality of the taps when the plurality of taps are detected;

a calculator that calculates a sampling duration on the basis of time intervals between the respective taps when the plurality of taps are detected, said calculating being performed from the sampling start point to a subsequent tap that is performed after said one tap; and a waveform sampler that samples the obtained audio waveform, said sampling starting from the designated sampling start point and ending in accordance with the calculated sampling duration.

2. The sampling device according to claim 1, wherein the detector detects the taps by the user during obtaining of the streaming audio waveform inputted by the obtainer.

3. The sampling device according to claim 1, wherein the sampling device generates tempo information on the basis of an average of the time intervals between the respective taps.

4. The sampling device according to claim 3, wherein the calculator calculates the sampling duration on the basis of the generated tempo information and a number of the taps that has been detected.

5. The sampling device according to claim 1, wherein the designator designates the sampling start point by shifting to a point on the audio waveform before the one tap, the amount of shift being a value based on an average of the time intervals between the respective taps.

6. A musical instrument, comprising:

an operating element that designates a pitch;

a generator that generates an audio waveform having the pitch that has been designated; and the sampling device according to claim 1.

7. A sampling method executed by a sampling device, comprising:

obtaining a streaming audio waveform;

detecting a tap by a user;

designating a sampling start point on the obtained audio waveform when at least a single tap has been detected by a detector, said designating being performed on the basis of one tap among a plurality of the taps when the plurality of taps are detected;

calculating a sampling duration on the basis of time intervals between the respective taps when the plurality of taps are detected, said calculating being performed from the sampling start point to a subsequent tap that is performed after said one tap; and sampling the obtained audio waveform, said sampling being performed from the designated sampling start point and ending in accordance with the calculated sampling duration.

8. A storage medium, comprising:

programs stored on a computer that controls a sampling device, the programs respectively executing:

obtaining of a streaming audio waveform;

detecting of a tap by a user;

designating of a sampling start point on the obtained audio waveform when at least a single tap has been detected by the detecting, said designating being performed on the basis of one tap among a plurality of the taps when the plurality of taps are detected;

calculating of a sampling duration on the basis of time intervals between the respective taps when the plurality of taps are detected, said calculating being performed from the sampling start point to a subsequent tap that is performed after said one tap; and sampling of the obtained audio waveform, said sampling being performed from the designated sampling start point and ending in accordance with the calculated sampling duration.

9. The sampling device according to claim 1, wherein the one tap is a first tap, and wherein the subsequent tap is a final tap.

10. The musical instrument according to claim 6, wherein the audio waveform generated by the generator is obtained by the obtainer.

* * * * *